US005147264A

United States Patent [19]

Braathen

[11] Patent Number: 5,147,264

[45] Date of Patent: Sep. 15, 1992

[54] RESISTANCE REEL FOR AN EXERCISER

[76] Inventor: Thor F. Braathen, N-3358 N., Eggedal, Norway

[21] Appl. No.: 613,910

[22] PCT Filed: Jun. 27, 1989

[86] PCT No.: PCT/NO89/00066

§ 371 Date: Dec. 6, 1990

§ 102(e) Date: Dec. 6, 1990

[87] PCT Pub. No.: WO90/00077

PCT Pub. Date: Jan. 11, 1990

[30] Foreign Application Priority Data

Jun. 30, 1988 [NO] Norway ..... 882927

[51] Int. Cl.[5] ..... A63B 21/015

[52] U.S. Cl. ..... 482/118; 482/120

[58] Field of Search ..... 242/132, 133, 72, 73; 272/136, 140; 482/114–118

[56] References Cited

U.S. PATENT DOCUMENTS 518,967 5/1984 Poole ..... 272/132
3,764,132 10/1973 Hepburn .
3,929,331 12/1975 Beeding .
3,995,853 12/1976 Deluty .
4,114,874 9/1978 Mattila .
4,171,832 11/1979 Thompson ..... 272/133
4,484,741 11/1984 Bingisser .
4,625,961 12/1986 Brand ..... 272/132
4,779,866 10/1988 Marshall et al. .

FOREIGN PATENT DOCUMENTS 1526974 5/1968 France .
2274322 1/1976 France .

*Primary Examiner*—Richard J. Apley
*Assistant Examiner*—D. F. Crosby
*Attorney, Agent, or Firm*—Wenderoth, Lind & Ponack

[57] ABSTRACT

A resistance reel for an exerciser includes an extractive band extractible against an adjustable force of resistance and rewound by a return spring. A central pin has mounted thereon an extraction section and a resistance section. The components of such sections that are rotatable relative to the central pin are connected by a clutch means for non-rotatable connection in an extraction direction and are freewheeling for rewinding of the extractive band. One end of the central pin is intended for non-rotatable attachment to a stationary point.

10 Claims, 4 Drawing Sheets

W
Y1
Y2
V
V3
J1
J
I
I2
I1
H3
H
H2
H1
K2
H4
K1
K
G
F8
F5
F2
F1
F
F3
F4
O
P1
P2
P
O2
L
O1
N
M
Z
Z1
Y
Ø
Ø1
F7
F6
V2
V1
V3
Y
Z
H
H1
H3
H4

RESISTANCE REEL FOR AN EXERCISER

BACKGROUND OF THE INVENTION

The present invention relates to a resistance reel for exercisers, and wherein an extractive band is pulled out against an adjustable force of resistance and is rewound by a return, spring.

A resistance reel of this type is known, e.g. from French Patent No. 2 274 322, where a resistance reel with the above stated properties is disclosed. Friction disks in a resistance section have full annular faces which are forced towards each other by a spring arrangement comprising a number of helical compression springs which are provided between a friction disk that is non-rotatingly mounted on a shaft and a compression disk which is provided on the shaft and which may, by means of a control wheel cooperating with threads on the shaft, be moved to or from the compression springs to adjust the pressure between the friction disks and thus the braking effect and resistance to unwinding the extractive band. Such control means is bulky, and the frictional heat generated between friction disks during use of the resistance reel may propagate, via the shaft, to the surrounding casing and may heat the casing to a high temperature which is uncomfortable when the casing is touched. A clutch means between the resistance section and an unwinding section is achieved by a free wheel and is bulky. Furthermore, it is stated in such French reference that the shaft is mounted in a casing of the reel, and that the casing is secured to a firm support, e.g. to a rail on a wall where the level of the casing may be adjusted. The casing or a cover thereof thus has to be strong enough to absorb the tensioning force and the point of attachment of the casing on the firm support when the resistance reel is used. This means that the casing must have a sturdy design and the entire resistance reel will consequently be of a large volume.

SUMMARY OF THE INVENTION

It is an object of the present invention to provide a resistance reel for exercisers where the above disadvantages are avoided, and to provide a resistance reel where different components may be readily mounted and where components which are subjected to wear can readily be exchanged. The resulting resistance reel will generate no uncomfortably hot surfaces during use, its maintenance is simple and it can readily be adjusted to a desired resistance against unwinding.

According to the invention this is achieved by the provision of a resistance reel with an extraction section and a resistance section which are provided on a central pin with a two-piece cover. The central pin is a load carrying component which is to be attached at one end thereof to a stationary support. The two-piece cover will thus have no load carrying function and the design thereof need not consider its sturdiness. The extraction section, resistance section, a clutch means connecting them and the central pin have structural features that permit production of a resistance reel having small dimensions and an attractive appearance. According to the present invention, all parts of the resistance reel which require high accuracy with regard to surface quality and tolerances preferably are manufactured from steel, whereas remaining parts are manufactured from plastic. This results in a very low total weight of the resistance reel. The extractive band preferably consists of 100% polyester and thereby is strong and flexible.

BRIEF DESCRIPTION OF THE DRAWINGS

An embodiment of a resistance reel according to the invention will be disclosed in more detail below with reference to the accompanying drawings, wherein.

DETAILED DESCRIPTION OF THE INVENTION

Figure 1:
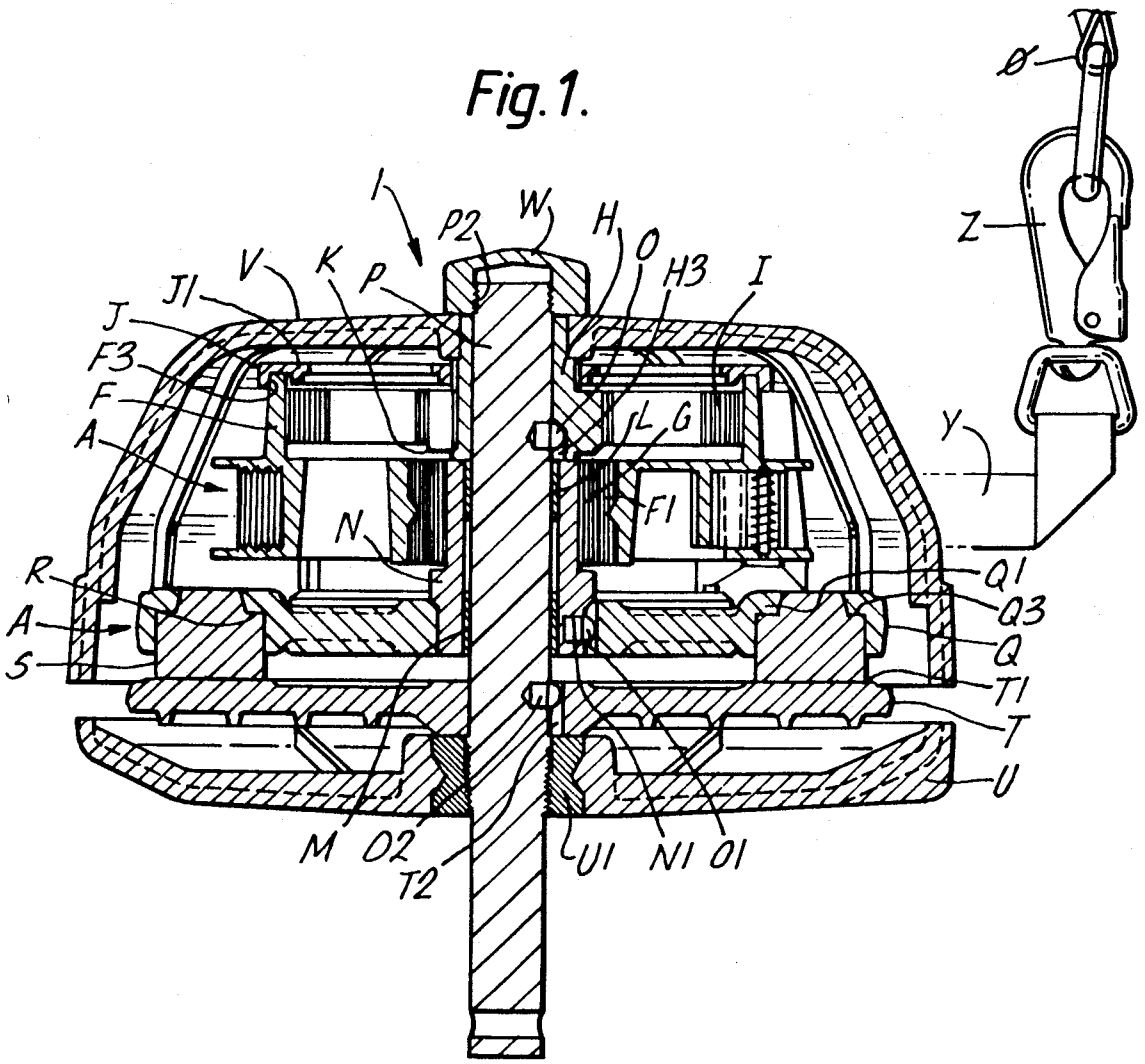
FIG. 1 is an axial section through the resistance reel with a wound-up extractive band.

Resistance reel 1, as shown in FIG. 1, comprises a central pin P on which an extraction section A, and a resistance section B are provided with components that are rotatable relative to central pin P and that are mutually connected, via a clutch G, N, for non-rotatable coupling in one direction when an extractive band Y is pulled out, and in a freewheeling manner for rewinding of the extractive band. One end of central pin P is intended for non-rotatable attachment to a stationary point, e.g. a door frame, if desired, via a socket.

Figures 2A, 2B, 2C:
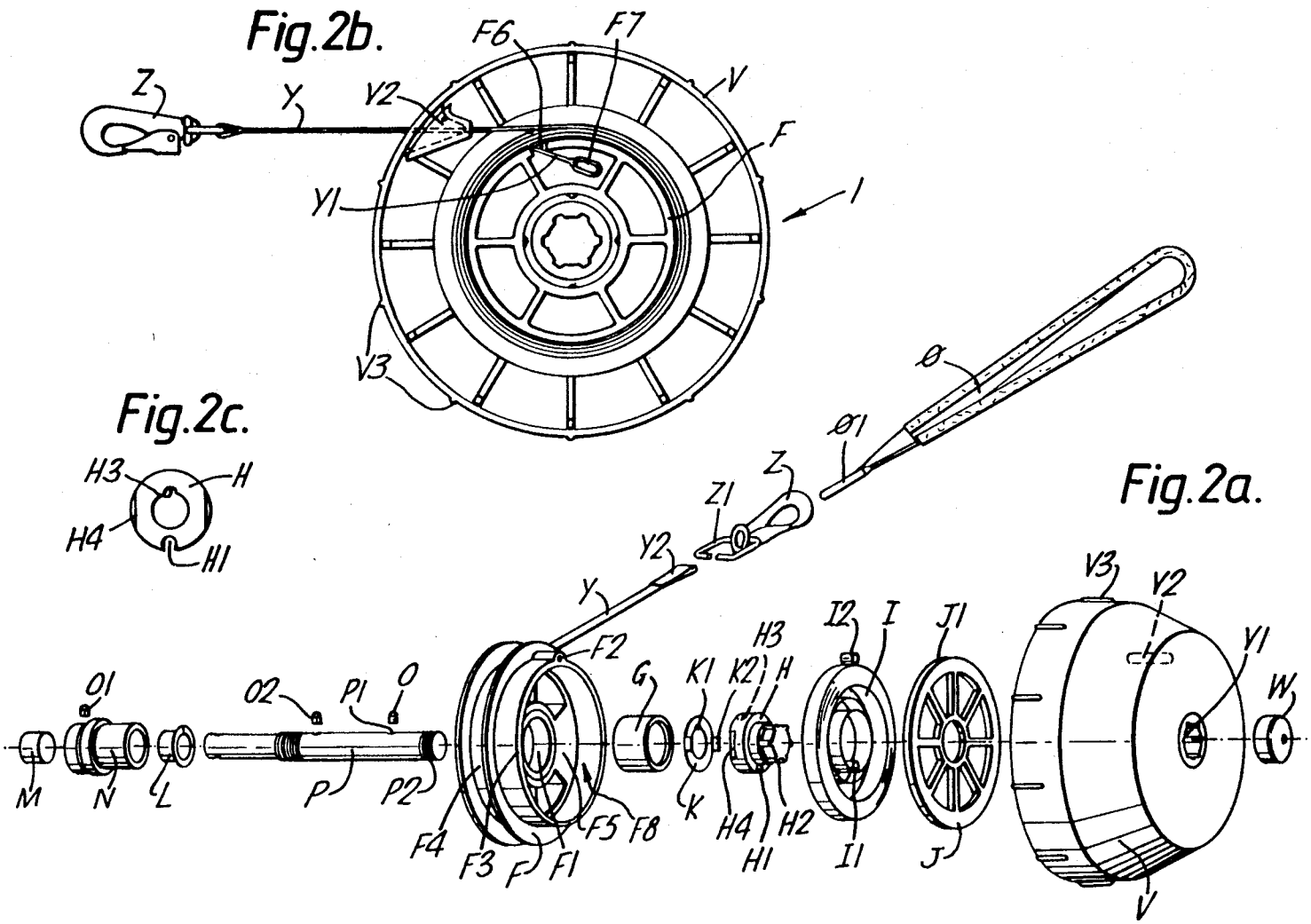
FIG. 2*a* is an exploded perspective view of an extraction section of the resistance reel with a central pin thereof.
FIG. 2*b* is an elevation view of the extraction section with the wound-up extraction band in a front cover and without the central pin.
FIG. 2*c* is a plan view of a tensioning sleeve.

Extraction section A comprises a reel member F (FIG. 2*a*) which is rotatably mounted on central pin P and which defines a reel groove F4 for receiving an extractive band Y and a spring casing F8 which is concentric with the reel groove and within which is mounted a return spring I. The spring I is a helical spring secured at an outer end I2 thereof to spring casing F8. Spring I is secured at an inner end I1 thereof to a tensioning sleeve H which is lockable against rotation on central pin P. The bearing of reel member F (FIG. 1) is a lock bearing G which is non-rotatably mounted in a central opening of reel member F and on a sleeve N which is rotatably mounted on central pin P by bearings L and M. Elements G and N form a non-rotatable component of resistance between reel member F and a rotatable component of resistance section B which is non-rotatably connected with the end of sleeve N.

Reel member F (FIG. 1) is a plastic wheel acting as a holder of return spring I and extractive band Y. A steel sleeve F1 is molded into the central portion of the reel member and lock bearing G is press-fit into sleeve F1. Spring casing F8 is provided which an undercut attaching groove F2 for outer end I2 of return spring I which is shaped with a bend fitting into attaching groove F2. Correspondingly, inner end Il of return spring I is shaped with a bend inserted into an undercut groove H1 in tensioning sleeve H. Reel groove F4 has high lateral edges to maintain extractive band Y in place and to prevent it from moving over the edges when the band is pulled out and rewound. At its external circular surface casing F8 of reel member F is provided with a locking edge F3 intended for cooperation with a corresponding locking groove J1 of a spring return cover J which is pressed onto spring casing F8 and retained by the cooperation of locking edge F3 and groove J1. A thrust washer K with wings K2 is provided on one end of tensioning sleeve H with wings K2 in contact with two opposite faces H4 on the surface of tensioning sleeve H.

As shown in FIG. 1, return spring I is located inside spring housing F8 of reel member F towards a bottom F5 thereof and is blocked against axial movement relative thereto by thrust washer K and spring-return cover J. Tensioning sleeve H is arranged centrally inside return spring I when the latter is mounted in spring casing F8. An outer end of sleeve H is provided with axial grooves H2 and projects outward through a central opening in spring return cover J. At its inner end tensioning sleeve H has an internal groove H3 for cooperation with a key bolt O provided in an aperture P1 in central pin P. Extractive band Y then is wound around reel groove F4. The outer end of extractive band Y has a loop Y2 which is passed through a slot V2 (FIG. 2*b*) in a side wall of front cover V and is then connected with a snaphook Z, via a compressible half link fastener Z1. Extraction section A composed of the above components is provided on central pin P (FIG. 2*a*) and retained thereon by a cap nut W cooperating with a thread P2 on the end of central pin P which projects through a central aperture V1 in front cover V. By tightening cap nut W, front cover V is urged towards a stop on tightening sleeve H, and extraction section A, central pin P, and front cover V are consequently assembled as a unit. When central pin P is inserted into the central opening of reel member F and tensioning sleeve H, return spring I is tensioned by turning tensioning sleeve H once before groove H3 engages key bolt O.

After mounting the above disclosed extraction section on central pin P, resistance section B may be mounted on central pin P. As shown FIGS. 1 and 3, resistance section B comprises two cooperating brake disks Q and T, one of which, i.e. disk T, is non-rotatably connected with central pin P. The other rotatable brake disk Q is axially displaceably and non-rotatably attached to one end of the sleeve N, which is rotatable on central pin P and forms one of two components of the clutch means. Non-rotatable brake disk T is axially displaceable to braking contact relative to rotatable brake disk Q by an adjusting nut U1 which cooperates with thread P3 on central pin P. An aperture N1 is provided in the rear end of sleeve N to receive a key bolt O1 that cooperates with a key slot in brake disk Q to permit relative axial displacement therebetween.

Figure 3:
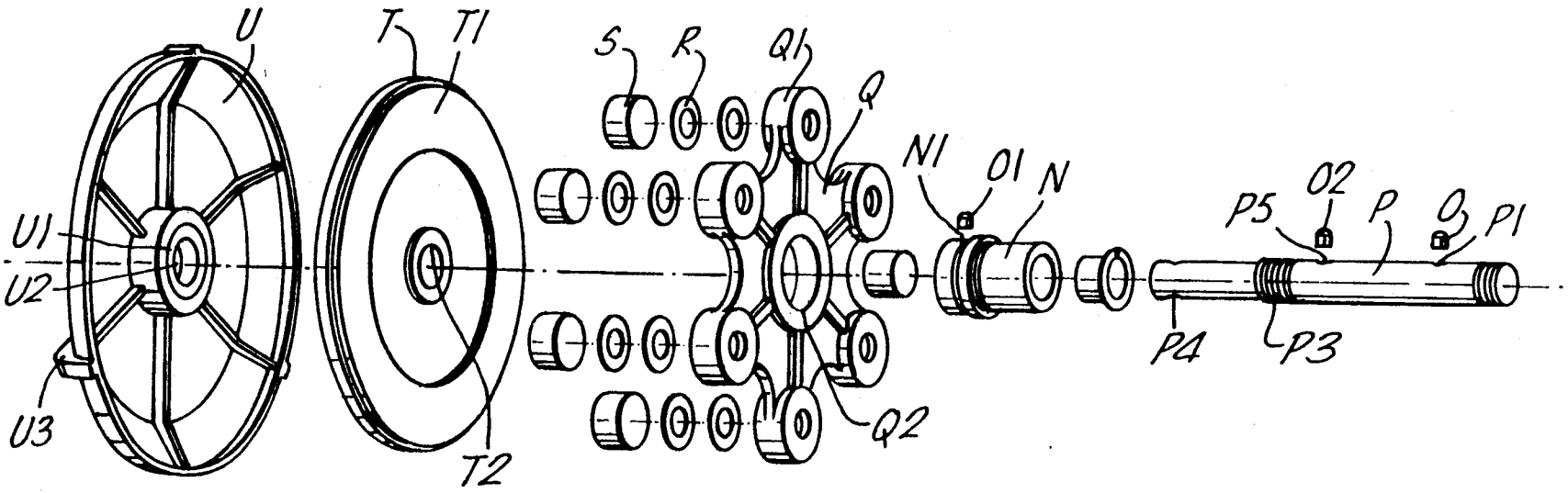
FIG. 3 is an exploded perspective view of a resistance section with the central pin.

One of brake disks Q and T, preferably rotatable brake disk Q as shown in the drawings, has at least three brake pads S, e.g. six brake pads evenly distributed around a circular center opening Q2 in disk Q. At least one spring washer R, possibly two as shown in FIG. 3, is provided between each brake pad S and a bottom of associated recess or opening in a portion Q1 of disk Q receiving pads, thereby ensuring resilient engagement between brake pads S and the other brake disk T. The recesses or openings in portions Q1 preferably are through holes and are provided with respective stop surfaces Q3 against which bear spring washers R. Brake pads S are mounted with a lateral clearance relative to the side walls of openings in portions Q1 in order to reduce heat transmission to brake disk Q and to the components of extraction section A when the completely mounted resistance reel 1 is operated. When brake disk Q is mounted on sleeve N, the other brake disk T may be mounted on central pin P and locked against rotation, an axial slot T2 being provided in the central opening of brake disk T for cooperation with a key bolt O2 which is provided in an opening P5 in central pin P. Brake disk T is, thus, axially displaceable relative to pin P.

The fact that brake pads S are provided on spring washers R in holes in portions Q1 in brake disk Q and that there is clearance between the walls of the holes and the brake pads, primarily results in smooth engagement between brake pads S and the opposite brake disk T, spring washers R compensating for any obliqueness between brake disks Q and T and for any uneven wear or any slight difference in height of brake pads S. Due to such clearance there will also be minimum heat transmission from brake pads S to brake disk Q and to bearings and other movable components of the resistance reel.

Adjusting nut U1 for adjustment of the brake pressure of non-rotatable brake disk T against pads S in rotatable brake disk Q is secured centrally in an adjusting cover U covering the free face of stationary brake disk T. Adjusting cover U, which preferably is plastic, and adjusting nut U1, which is preferably an internally threaded steel sleeve molded inside adjusting cover U, are screwed onto thread P3 of central pin P. One end of adjusting nut U1 will thus bear on stationary brake disk T. The engagement between brake disk T and pads S of brake disk Q is thus adjustable by rotation of adjusting cover U.

Figure 4:
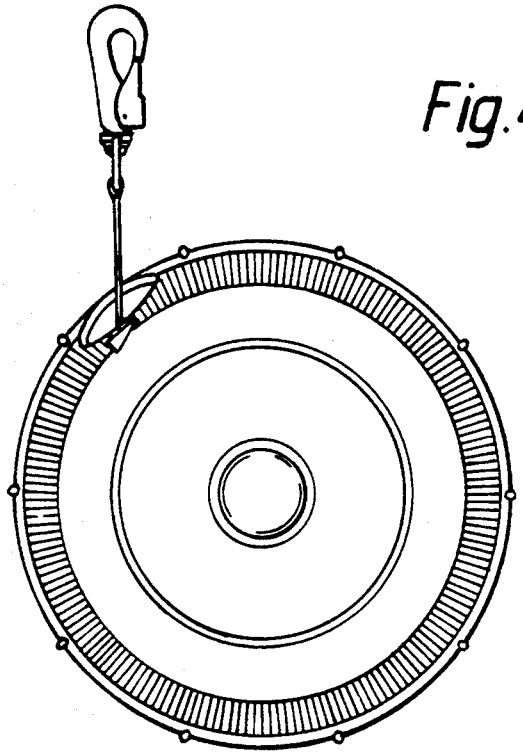
FIGS. 4, 5, and 6 are front, side and rear elevations of the resistance reel.
Figure 5:
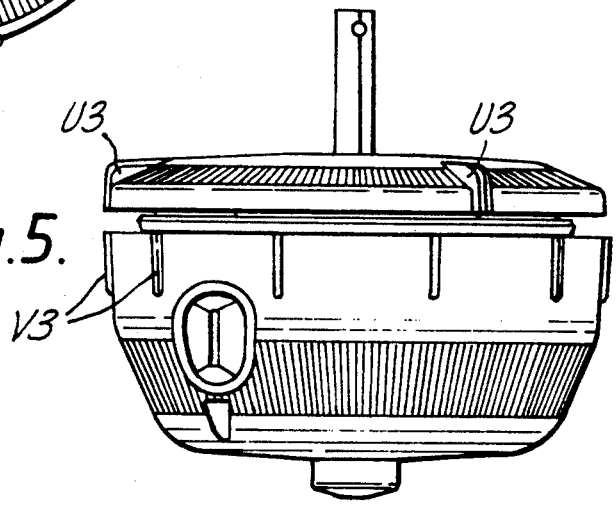
Figure 6:
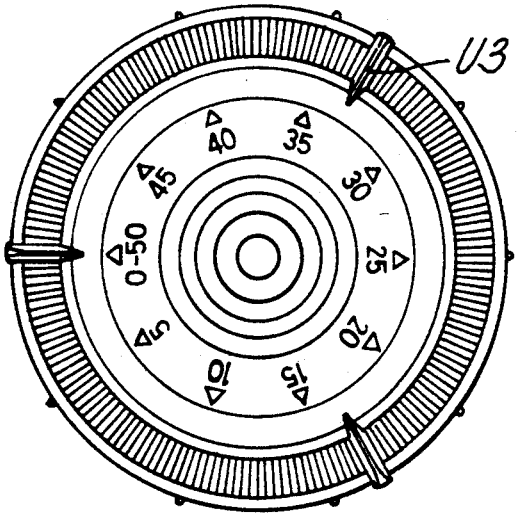

When the resistance reel, if desired two resistance reels in the form of an exerciser, is to be used, resistance reel 1 or both resistance reels must be mounted by mountings to a stationary support, e.g. to a door frame or a wall, so that extractive bands Y of the respective resistance reels can be pulled out in desired directions. Before resistance reel 1 is used, adjustment cover U is screwed in towards non-rotatable brake disk T which is, in turn, pushed towards brake pads S on rotatable brake disk Q. By the aid of such adjustment of the contact pressure between brake disk T and brake pads S on the other brake disk Q, the force of resistance against pulling out extractive band Y can be adjusted from 0 kg and up to the desired resistance, e.g. up to 50 kg. Cover U is provided with three radially extending wings U3 operable both to form finger holds for tightening the adjustment cover and to act as indicators of kilo intervals of the force of resistance (see FIGS. 4, 5, 6). Around the periphery of front cover V are equally spaced ten bosses V3. Together with wings U3 on adjustment cover U, bosses V3 indicate intervals of resistance. For example, if one of wings U3 is placed opposite to one of bosses V3 and then is rotated to the next boss, the force of resistance is increased or decreased, e.g. by 5 kg. The intervals between each boss V3 thus represent a change of the force of resistance by 5 kg, and a complete turn of adjusting cover U thus represents a change of 50 kg if resistance. The rear face of adjusting cover U is marked 0–50, as shown in FIG. 6.

The above mentioned change of the force of resistance by turning adjusting cover U corresponding to boss intervals on front cover V obviously is true only for a particular embodiment of the resistance reel, since the force of resistance depends on the number of brake pads S and the distance thereof from central pin P. Even though brake pads S will gradually be worn and the adjusting cover U must be screwed further inward to provide the desired force of resistance, the value of adjusting intervals between two bosses V3 will remain the same. Worn-out brake pads S can simply be replaced by new pads. Adjusting cover U is then screwed out, brake disk T is removed, brake pads S are replaced, and the components are assembled again without the use of tools. When the desired force of resistance in kg is set, exercise may begin.

When extractive band Y is pulled out, reel member F and brake disk Q are simultaneously rotated since lock bearing G is locked to sleeve F1 of the reel member F and to sleeve N is locked to and pulls along brake disk Q. Brake pads S consist of a material free of asbestos and with very good friction, and which when urged against friction fact T1 of stationary friction disk T will provide the desired force of resistance against pulling out of extractive band Y. Brake disk T is provided on its rear face with a number of ribs which contribute to increasing the surface of thermal conductivity for frictional heat generated between the friction disks when the resistance reel is used. Due to the above mentioned clearance between holes in sections Q1 and brake pads S, there is negligible heat transmission to brake disk Q. When extractive band Y is pulled out, return spring I is simultaneously tightened, and when the load is removed from extractive band Y, spring I will rotate reel F in a return direction and at the same time wind extractive band Y onto reel groove F4.

Such constant extraction/rewinding of extractive band Y at the same time as reel member F rotates in opposite directions will occur in an almost soundless manner due to the fact that return spring I is well encapsulated between reel member F and spring cover J. Return spring I cannot move laterally, and all parts which are in contact with the return spring are made of plastic.

When extractive band Y is no longer pulled and reel member F rotates in the return direction while extractive band Y is rewound in reel groove F4 by return spring I, brake disk Q will stop at the position it had when extraction stopped. This is due to the fact that lock bearing G holds sleeve N during rotation of reel member F in the extraction direction, but will release its hold on sleeve N during rotation of member F in the opposite direction. Reel member F thus can rotate in both directions, whereas brake disk Q only rotates in the direction of extraction.

When the resistance reel disclosed above was tested, return spring I proved to break down after a certain number of operations of extension and rewinding of extractive band Y. This was caused by fatigue of return spring I. It was desirable to achieve a longer life of return spring I, and various types of spun return springs were tested. A spring spun of spring bands to form a conical spring, which when mounted in spring casing F8 of reel member F is compressed to a flat helical spring in the spring casing, surprisingly proved to attain a considerably longer life before break-down, compared to a previously used common coil spring.

Cap nut W on the end of central pin P adjacent to front cover V may be provided with an opening at its closed end to receive a rod (not shown). When two resistance reels are mounted facing each other in a door opening or the like such a rod may extend from the opening of one cap nut W to the opening in the second cap nut W in the two resistance reels. If the rod is axially extendable, the resistance reels and their sockets may thus be thrust towards the edges of the door opening, thus resulting in better attachment. Additionally, such rod may be used in connection with exercise. If the resistance reels are mounted at a low level, such a rod may be used for a counter hold for the legs of a person doing sit-ups, or it may be used in connection with push-ups when resistance reels and the rod are mounted at a higher level in the door openings.

I claim:

1. A resistance reel for an exerciser, said reel comprising:

a central pin having a supporting first end including means for attaching said central pin to a stationary position for support of said reel, and said central pin having a free second end;

an extraction section mounted on said central pin and supporting an extraction band to be unwindable therefrom and a return spring for rewinding said extractive band;

a resistance section mounted on said central pin for imparting an adjustable resistance force to unwinding of said extractive band;

said extraction section and said resistance section having respective components that are rotatable relative to said central pin;

clutch means connecting said components to prevent relative rotation therebetween during rotation thereof in an extraction direction of said extractive band and allowing relative rotation therebetween during rewinding of said extractive band;

whereby during use of said reel, pulling of said extractive band from aid extraction section generates pulling forces that are transferred to said central pin via said extraction section and said resistance section; and a cover substantially enclosing said reel and including two separate portions that individually are mounted on and supported solely by said central pin at respective locations and by respective means substantially preventing said cover portions from being loaded by said pulling forces.

2. A resistance reel according to claim 1, wherein said extraction section comprises a reel member defining a reel groove for said extractive band and a spring casing concentric with said reel groove for said return spring, said return spring comprises a helical spring having an outer end attached to said spring casing and an inner end attached to a tensioning sleeve that is locked against rotation on said central pin for tensioning said return spring, and said clutch means comprises a lock bearing non-rotatably arranged in a central opening of said reel member and mounted on a sleeve which is spaced axially of said resistance section and which is rotatably mounted on said central pin to achieve non-rotatable connection and to allow relative rotation between said reel member and said rotatable component of said resistance section which is non-rotatably connected with an axial end of said sleeve.

3. A resistance reel according to claim 2, wherein said resistance section comprises first and second cooperating brake disks, said first disk being non-rotatably connected to said central pin, and said second disk being non-rotatably attached to said axial end of said sleeve at a position spaced axially of said extractive band, said first disk being axially displaceable to braking contact with said second disk by an adjusting nut cooperating with threads on said central pin.

4. A resistance reel according to claim 3, wherein one of said brake disks is provided with at least three brake pads which are mounted in respective openings evenly spaced about said one disk, at least one spring washer being positioned between each said brake pad and a bottom of the respective said opening.

5. A resistance reel according to claim 4, wherein each said opening comprises a through hole defining a stop for said spring washer.

6. A resistance reel according to claim 4, wherein each said brake pad is arranged with lateral clearance to a sidewall defining the respective said opening.

7. A resistance reel according to claim 3, wherein said adjusting nut is mounted radially centrally of and integral with a first said cover portion covering a free side of said first brake disk, said adjusting nut abutting said first brake disk.

8. A resistance reel according to claim 1, wherein one said cover portion defines a front cover for said extraction section and has a central opening receiving a threaded portion of said second free end of said central pin, and further comprising a cap nut securing said front cover on said threaded portion of said second free end against a stop of said central pin, said front cover having a lateral opening for passage of said extractive band.

9. A resistance reel according to claim 6, wherein said cap nut has an opening at a top thereof for receipt of a rod to extend between two said resistance reels which are mounted opposite to each other in a door opening or the like.

10. A resistance reel according to claim 1, wherein said return spring comprises a spring band in the form of a conical spring which is axially compressed to the shape of a flat helical spring.

* * * * *